United States Patent [19]

Janosch

[11] 4,095,311

[45] Jun. 20, 1978

[54] HINGES

[75] Inventor: Hans Janosch, Chateauguay, Calif.

[73] Assignee: Phil Menard Limitee, Montreal, Canada

[21] Appl. No.: 728,908

[22] Filed: Oct. 4, 1976

[51] Int. Cl.[2] ..... E05D 3/06

[52] U.S. Cl. ..... 16/163

[58] Field of Search ..... 16/128 R, 135, 163, 16/164, 166

[56] References Cited

U.S. PATENT DOCUMENTS

| | | | |
|---|---|---|---|
| 2,355,542 | 8/1944 | Loftin | 16/163 |
| 3,203,032 | 8/1965 | Everett | 16/163 |
| 3,425,766 | 2/1969 | Crisera | 16/163 X |
| 3,777,155 | 1/1957 | Fata | 16/164 |

FOREIGN PATENT DOCUMENTS

| | | | |
|---|---|---|---|
| 82,063 | 2/1957 | Denmark | 16/163 |
| 2,109,485 | 9/1972 | Germany | 16/135 |
| 1,128,598 | 9/1968 | United Kingdom | 16/164 |

*Primary Examiner*—James Kee Chi

*Attorney, Agent, or Firm*—Charles E. Brown

[57] ABSTRACT

The invention relates to a novel hinge arrangement, which is particularly useful in shelving units, and to shelving units employing such a hinging arrangement. The shelving unit includes a fixed wall and a shelf part, and the top edge of the fixed wall is contiguous to the bottom edge of the shelf. The right and left hand edges of the fixed wall and the shelf are respectively pivotally connected by right and left hand hinge arrangements. Each of the hinge arrangements includes a base member, connected to a respective edge of the fixed wall, and a swivelling member, connected to a respective edge of the shelf. Connecting members are provided to pivotally connect each base member with its respective swivelling member, so that the shelf is pivotable relative to the fixed wall.

8 Claims, 5 Drawing Figures

HINGES

BACKGROUND OF THE INVENTION

1. Field of the Invention

The invention relates to a novel hinge arrangement. More specifically, the invention relates to a hinge arrangement which is especially useful for shelving units, and for shelving units including the novel hinge arrangement.

2. Statement of the Prior Art

It is known to use door hinges for providing pivoting support of a shelf in a shelving unit. The door hinge includes a base, or fixed member, and a swivelling member, each said member having a series of spaced cylinders disposed along an edge thereof, the cylinders of the base member being arranged for mating engagement with the cylinders of the swivelling member. A pin is inserted in the mated cylinders to maintain the swivelling member in pivoting engagement with the base member. The base member is connected to an anchored or fixed part of the shelving arrangement, while the swivelling member is connected to the shelf, whereby the shelf is pivotally connected to the fixed part.

In this unit, no support is provided for the shelf in its horizontal position. To maintain the shelf in its horizontal position, it is necessary to provide support members which extend, under the shelf, outwardly from the fixed part.

Hinges including an elongated connecting member are also known as is evidenced in U.S. Pat. No. 916,648, Aurand, Mar. 30, 1909. However, this hinge is not contemplated for use in a shelving unit, and is further different in concept, structure and operation from the inventive hinge herein.

SUMMARY OF THE INVENTION

It is an object of the invention to provide a novel hinge arrangement.

More specifically, it is an object of the invention to provide a novel hinge arrangement which is useful in shelving units.

It is a further object of the invention to provide a shelving unit employing such a hinge arrangement, whereby, when the shelf is disposed in its horizontal position, the shelf will be supported by the fixed part of the shelving unit.

In accordance with the invention a hinge arrangement comprises, in combination: a base member having a first end; a swivelling member having a first end; the first end of the base member being disposed contiguous to the first end of the swivelling member; and first and second connecting members pivotally connecting said base member with said swivelling member at the first ends thereof; said first connecting member being pivotally connected, at one end thereof, to one side of the one end of said base member, and, at the other end thereof, to the corresponding side of the one end of said swivelling member; said second connecting member being pivotally connected, at one end thereof, to the other side of the one end of said base member and, at the other end thereof, to the other side of the one end of said swivelling member.

In one embodiment, extensions are provided at each side of the one end of said base member, said extensions extending in the direction of said swivelling member; said first and second connecting members being connected, at the one ends thereof, to respective ones of said extensions.

The hinge arrangement may further comprise an arcuately shaped extension extending outwardly and in the direction of said base member from one side of the one end of said swivelling member; said first and second connecting members being connected, at the other ends thereof, to the base and tip respectively of said arcuately shaped extension.

The first and second connecting members may be arcuate in shape, whereupon the bowed portions of said connecting members face each other.

From another aspect, in accordance with the invention, a shelving unit comprises, in combination: a fixed part having a bottom edge and a right hand edge and a left hand edge; a shelf part having a top edge and a right hand edge and a left hand edge; the shelf part being disposed such that the bottom edge thereof is contiguous to the top edge of the fixed part and the right hand and left hand edges thereof are adjacent the right hand and left hand edges respectively of the fixed part; and hinge arrangements disposed at the right hand edges and left hand edges, respectively, of said fixed part and said shelf part; each hinge arrangement comprising: a base member having a first end; a swivelling member having a first end; the base member and the swivelling member of the right hand hinge arrangement being connected, to the right hand edges of said fixed member and said shelf member, respectively; the base member and the swivelling member of the left hand hinge arrangement being connected to the left hand edges of the fixed member and the shelf member, respectively; first and second connecting members pivotally connecting each said base member with a respective one of each said swivelling member at the first ends thereof; each said first connecting member being pivotally connected, at one end thereof, to one side of the one end of its respective base member and, at the other end thereof, to the corresponding side of the one end of the respective swivelling member; each said second connecting member being pivotally connected, at one end thereof, to the other side of the one end of its respective base member and, at the other end thereof, to the other side of the one end of the respective swivelling member; whereby said shelf part is pivotally connected to said fixed part.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
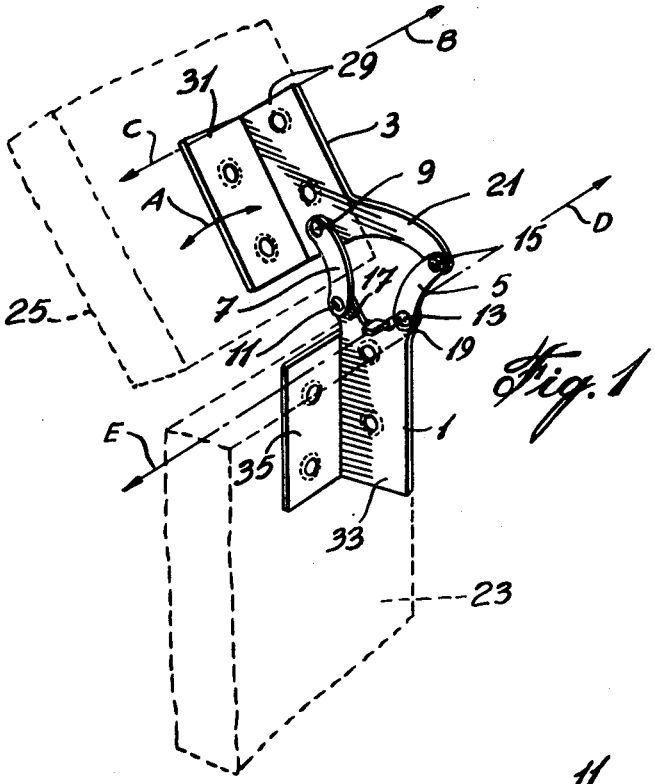
FIG. 1 is a perspective view of a right hand hinge in accordance with the invention in its midway position.

Referring now to the drawings, the novel hinge arrangement includes a base member 1 and a swivelling member 3, the members being joined by elongated connecting members 5 and 7. In the preferred embodiment, the members 5 and 7 are arcuate in shape, and they are disposed in the arrangement such that the bowed portions of the members face each other.

The member 5 is pivotally connected, at one end thereof, to one side of one end of the member 3 by means such as a rivet 9, and is pivotally connected, at the other end thereof, to the corresponding side of one end of the member 1 by means such as a rivet 11. In the same way, member 5 is pivotally connected, at respective ends thereof, to corresponding sides of the one end of member 1 and the one end of member 3 by rivets 13 and 15 respectively. Preferably, the member 1 includes extensions 17 and 19 at either side of the one end thereof, and the connecting members 5 and 7 are connected to the extensions 19 and 17 respectively.

The member 3 includes an elongated extension 21, which is preferably arcuate in shape and which extends outwardly and downwardly from the one end of the member 3. The other ends of members 5 and 7 are connected, respectively, to the tip and base of the extension 21.

With this arrangement, the tip of extension 21 is pivotal relative to the member 5 (and vice versa) which is, in turn, pivotal relative to the extension 19 (and vice versa). The base of 21 is pivotal relative to the member 7 (and vice versa) which is, in turn, pivotal relative to the extension 17 (and vice versa). Thus, the member 3 is pivotal relative to the member 1, in the directions indicated by the arrow A in FIG. 1.

Figure 2:
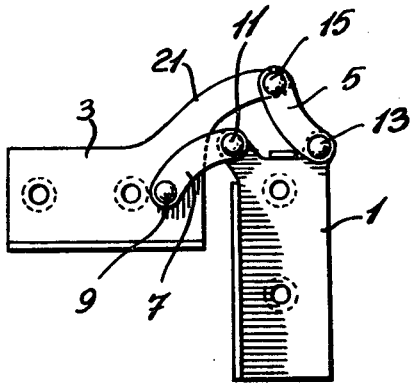
FIG. 2 is a view of the hinge in FIG. 1 with the swivelling member disposed at right angles to the base member.
Figure 3:
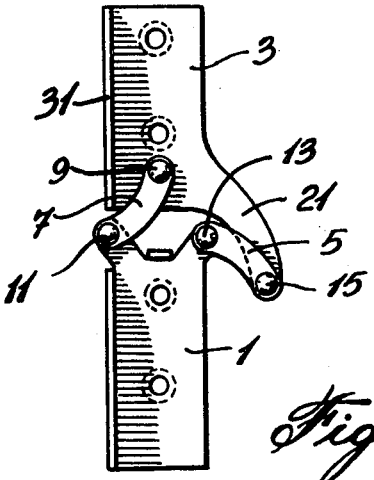
FIG. 3 is a view of the hinge of FIG. 1 with the swivelling member in line with the base member.

FIG. 2 illustrates the relationships of the various parts of the hinge arrangement when the swivelling member 3 is at right angles to the base member 1, and FIG. 3 illustrates the relationships of the various parts of the hinge arrangement when the swivelling member 3 is in line with the base member 1.

Figure 4:
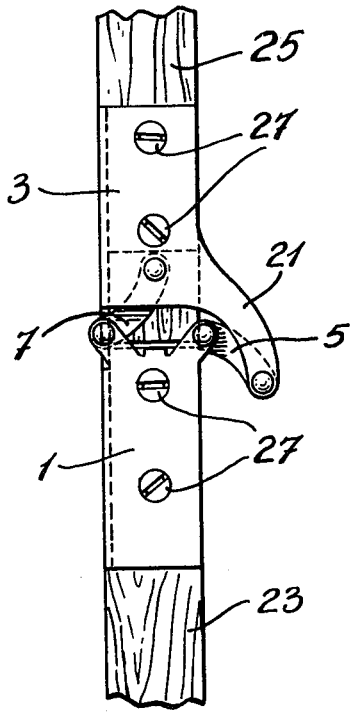
FIG. 4 is a partial side view of a shelving unit using the hinge arrangement with the shelf part in line with the fixed part.
Figure 5:
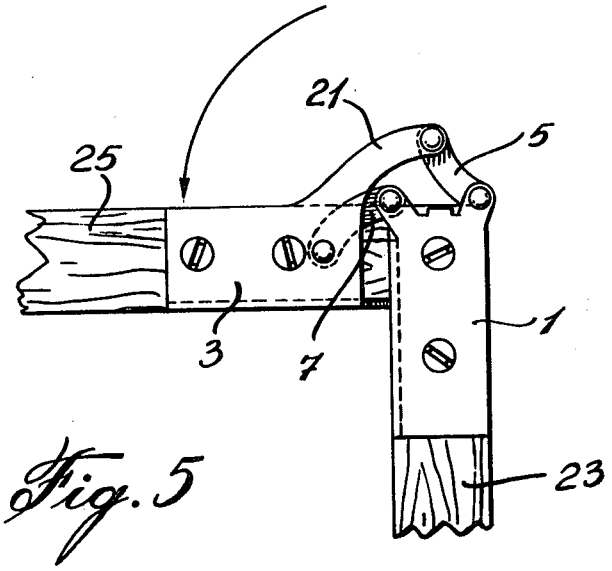
FIG. 5 is a partial side view of a shelving unit using the hinge arrangement with the shelf part at right angles to the fixed part.

Turning now to FIGS. 4 and 5, the hinge members are mounted at either edge of a fixed part 23, such as a wall, of a shelving arrangement and a shelf part 25 of the shelving arrangement. In this regard, the hinge which is mounted on the right edge of the parts 23 and 25 will have its parts arranged differently than a hinge arrangement which is mounted on the left hand side. Thus, if the member 3 comprises an angle iron (see FIG. 1) having an edge engaging portion 29 and a front engaging portion 31, 31 extends at right angles to 29 in the direction of the arrow B for a right edge hinge, but extends at right angles to 29 in the direction of the arrow C for a left edge hinge. In the same way, when 1 comprises an angle iron having an edge engaging portion 33 and a front engaging portion 35, 35 extends at right angles to 33 in the direction of arrow D for a right edge hinge, and in the direction of arrow E for a left edge hinge.

The hinges are attached to their respective parts by means such as screws 27.

As can be seen in FIG. 4, when the shelf is in the upright position, the bottom edge of 25 abuts the top edge of 23 to retain the shelf in its upright position. When the shelf is opened (in its horizontal position), as seen in FIG. 5, the bottom edge of 25 abuts the front face of 23. Any downward pressure on 25 will be absorbed by the front face of 23, and the shelf is supported in its open or horizontal position. As is clear, no further support means are necessary for the shelf.

Although only one embodiment was above described, this was for the purpose of illustrating, but not limiting, the invention. Various modifications, which will come readily to the mind of one skilled in the art, are within the scope of the invention as defined in the appended claims.

I claim:

1. A hinge arrangement comprising, in combination:
a base member having a first end;
a swivelling member having a first end;
the first end of the base member being disposed contiguous to the first end of the swivelling member; and
first and second elongated connecting members pivotally connecting said base member with said swivelling member at the first ends thereof;
said first connecting member being pivotally connected, at one end thereof, to one side of the one end of said base member and, at the other end thereof, to the corresponding side of the one end of said swivelling member;
said second connecting member being pivotally connected, at one end thereof, to the other side of the one end of said base member and, at the other end thereof, to the other side of the one end of said swivelling member; and
further comprising an extension member extending outwardly and in the direction of said base member from one side of the one end of said swivelling member;
said first and second connecting members being connected, at the other ends thereof, to the base and tip respectively of said extension member.

2. A hinge arrangement as defined in claim 1 and further comprising extensions at each side of the one end of said base member, said extensions extending in the direction of said swivelling member;
said first and second connecting members being connected, at the one ends thereof, to respective ones of said extensions.

3. A hinge arrangement as defined in claim 1 wherein said extension member is arcuately shaped.

4. A hinge arrangement as defined in claim 1 wherein each said first and second connecting member is arcuate in shape, the bowed portions of said connecting members facing each other.

5. A shelving unit comprising, in combination:
a fixed part having a bottom edge and a right hand edge and a left hand edge;
a shelf part having a top edge and a right hand edge and a left hand edge;
the shelf part being disposed such that the bottom edge thereof is contiguous to the top edge of the fixed part and the right hand and left hand edges thereof are adjacent the right hand and left hand edges respectively of the fixed part;
and hinge arrangements disposed at the right hand edges and left hand edges, respectively, of said fixed part and said shelf part;
each hinge arrangement comprising:
a base member having a first end;
a swivelling member having a first end;
the base member and the swivelling member of the right hand hinge arrangement being connected, to the right hand edges of said fixed member and said shelf member, respectively;
the base member and the swivelling member of the left hand hinge arrangement being connected to the left hand edges of the fixed member and the shelf member, respectively;

first and second elongated connecting members pivotally connecting each said base member with a respective one of each said swivelling members at the first ends thereof;

each said first connecting member being pivotally connected, at one end thereof, to one side of the one end of its respective base member and, at the other end thereof, to the corresponding side of the one end of the respective swivelling member;

each said second connecting member being pivotally connected, at one end thereof, to the other side of the one end of its respective base member and, at the other end thereof, to the other side of the one end of the respective swivelling member;

whereby said shelf part is pivotally connected to said fixed part; and further comprising an extension member extending outwardly and in the direction of respective ones of said base members from one side of the one end of a respective one of each said swivelling members;

respective ones of said first and second connecting members being connected, at the other ends thereof, to the base and tip respectively of respective ones of said extension members.

6. A shelf unit as defined in claim 5 and further comprising extensions at each side of the one end of each said base member, said extensions extending in the direction of respective ones of said swivelling members;

respective ones of said first and second connecting members being connected, at the one ends thereof, to respective ones of said extensions.

7. A shelving unit as defined in claim 5 wherein each said first and second connecting members is arcuate in shape, the bowed portions of adjacent connecting members facing each other.

8. A shelf as defined in claim 5 wherein said extension members are arcuately shaped.

* * * * *